United States Patent [19]

Sublett

[11] Patent Number: 4,903,723

[45] Date of Patent: Feb. 27, 1990

[54] COLLECTION BASIN AND DRAIN FOR DISHWASHER LEAKAGE

[76] Inventor: Tommy J. Sublett, 2406 Florida Ct., Columbia, Mo. 65201

[21] Appl. No.: 331,857

[22] Filed: Apr. 3, 1989

[51] Int. Cl.[4] ..... D06F 35/00

[52] U.S. Cl. ..... 137/312; 137/392; 340/604; 340/605; 340/620; 417/36; 4/252 A

[58] Field of Search ..... 4/252 A, 613, 614; 68/207; 134/57 D; 137/312, 392, 565; 340/604, 605, 618, 620; 417/36

[56] References Cited

U.S. PATENT DOCUMENTS

| | | | |
|---|---|---|---|
| 1,017,167 | 2/1912 | Pleins | 4/613 |
| 3,069,671 | 12/1962 | Taylor | 137/312 |
| 3,091,111 | 5/1963 | Cruse et al. | 417/36 |
| 3,200,388 | 8/1965 | Uhlig | 340/604 |
| 3,304,950 | 2/1967 | Hubert | 137/312 |
| 3,671,142 | 6/1972 | Calabrese | 417/36 |
| 3,770,002 | 11/1973 | Brown | 137/312 |
| 4,291,423 | 9/1981 | Wilson | 4/613 |
| 4,418,712 | 12/1983 | Braley | 137/312 |
| 4,541,446 | 9/1985 | Hogan | 417/36 |
| 4,765,360 | 8/1988 | Baird | 137/312 |

*Primary Examiner*—George L. Walton

*Attorney, Agent, or Firm*—Kokjer, Kircher, Bradley, Wharton, Bowman & Johnson

[57] ABSTRACT

A collection basin for collecting leakage from an automatic dishwashing machine. A drain or pump may be provided for removing the leakage collecting in the basin. Flanges extending along the sidewalls of the basin in combination with the sidewalls facilitate installation and removal of the dishwashing machine by guiding the machine support legs.

5 Claims, 1 Drawing Sheet

COLLECTION BASIN AND DRAIN FOR DISHWASHER LEAKAGE

BACKGROUND OF THE INVENTION

This invention relates in general to automatic dishwashing machines and, more particularly, to a basin for collecting and draining leakage from such machines.

Automatic dishwashing machines have become a common kitchen appliance and are typically installed under the kitchen counter. A problem commonly encountered with dishwashing machines is the failure of the watertight seals such as those about the loading door. During each washing cycle, water may then leak from the machine onto the floor. This type of leakage often goes unnoticed by the homeowner because of the recessed location of the machine. Often only a small quantity of water leaks from the machine and quickly penetrates into the flooring so that even if the homeowner were to examine the flooring beneath the dishwasher, there would be no visual signs of leakage. Over a period of time, the undetected leakage may cause considerable damage to the flooring in the vicinity of the machine as well as the ceiling in the room below the kitchen. The first noticeable signs of water leakage are often evident only after considerable damage has occurred to the floor and ceiling below.

The recessed location of the dishwashing machine makes it difficult to conduct periodic inspections of the floor for evidence of damage. Removal of the dishwasher to inspect the floor can be difficult because there is generally little clearance between the machine and the adjacent cabinets. Sliding the machine support legs along the often irregular floor surface while maintaining the machine in the required alignment is a difficult task, at best.

SUMMARY OF THE INVENTION

It is an object of this invention to provide a collection basin for installation below an automatic dishwashing machine to collect water leakage and prevent water damage to the floor beneath the machine as well as the ceiling in a room below.

As a corollary to the preceding object, it is a further object of this invention to provide a drain in the collection basin to route the leakage to a suitable disposal location so that water does not accumulate in the collection basin.

It is also an object of this invention to provide a collection basin for installation beneath an automatic dishwashing machine with a pump and a moisture sensor so that water accumulating in the collection basin may be pumped to a remote location so that water does not overflow the collection basin.

It is a still further object of this invention to provide flanges on a collection basin for installation beneath an automatic dishwashing machine for supporting and guiding the machine support legs so that the machine may be easily installed and removed even when positioned within a recessed area with close tolerances.

To accomplish these and other related objects of the invention, a collection basin is provided which is sized for insertion beneath an automatic dishwashing machine. A front wall of the basin includes a cutout region for providing clearance when the dishwashing machine is installed and removed after the collection basin has been installed. A drain is provided in the basin for routing leakage collecting in the basin to a remote location such as a sink drain pipe. A pump with a moisture sensor may optionally be provided for removing the water from the basin.

Flanges along the side edges of the basin, in combination with the side walls of the basin, provide guide surfaces for maintaining the machine in proper alignment to facilitate installation and removal of the machine.

BRIEF DESCRIPTION OF THE DRAWINGS

In the accompanying drawings in which like reference numerals are used to indicate like parts in the various views.

DESCRIPTION OF THE PREFERRED EMBODIMENT

Figure 1:
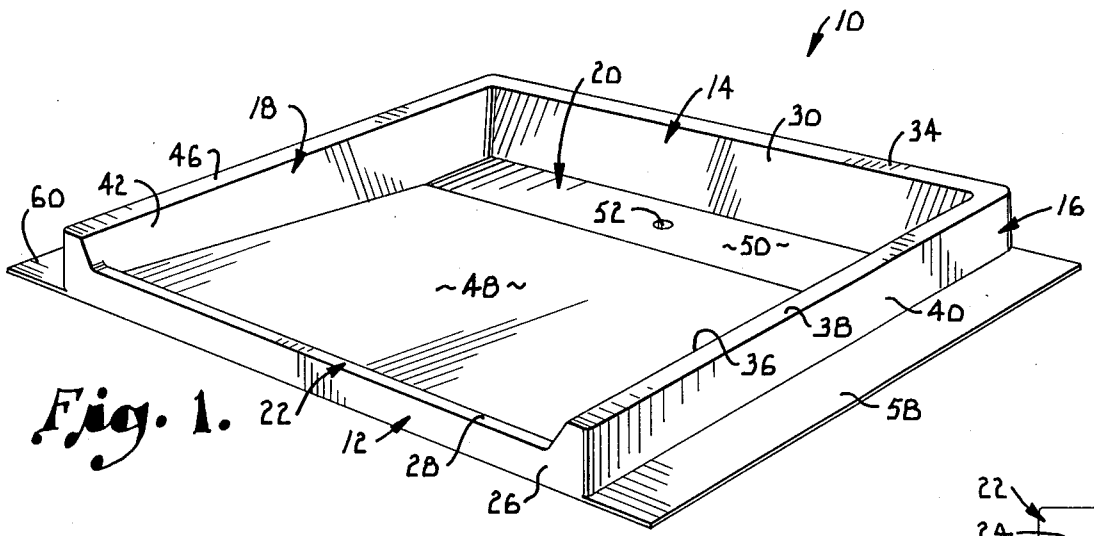
FIG. 1 is a top perspective view of a collection basin equipped with a drain according to one embodiment of the present invention.
Figure 3:
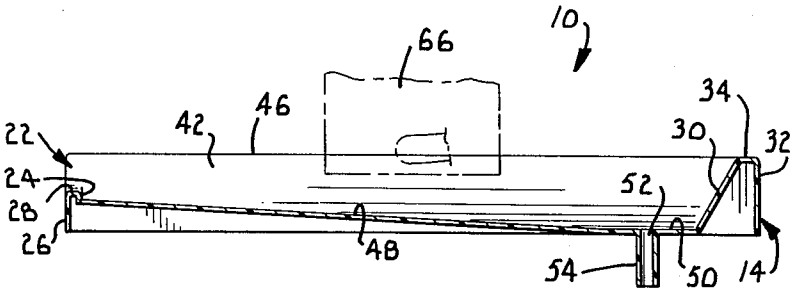
FIG. 3 is a fragmentary side sectional view of the collection basin taken along line 3—3 of FIG. 2.
Figure 2:
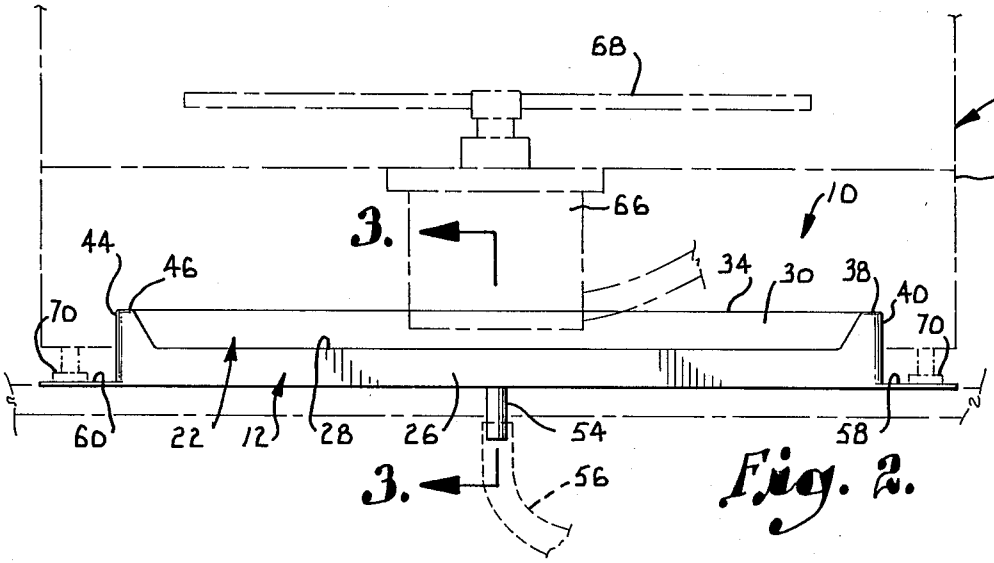
FIG. 2 is a front elevational view of the collection basin of FIG. 1 with portions of an automatic dishwashing machine shown somewhat schematically in phantom lines.

Referring now to the drawings in greater detail, and initially to FIGS. 1–3, a collection basin of the present invention is represented generally by the numeral 10. Basin 10 comprises front and rear walls 12 and 14 and sidewalls 16 and 18 which cooperate with a bottom 20 to form a container which is open at the top. Front wall 12 includes a cutout region 22 which extends substantially from one sidewall to the other.

Each of the front, rear and sidewalls 12, 14, 16 and 18 are constructed in a similar double-walled fashion. Front wall includes a generally vertical inner wall 24 which is connected to a vertical outer wall 26 by a flange 28 which extends horizontally between the top edges of the inner and outer walls. Rear wall 14 includes an inner wall 30 which slopes inwardly from its top to bottom edge. An outer wall 32 is spaced from the inner wall with a horizontal flange 34 connecting the top edges of the outer and inner walls. Sidewall 16 is likewise constructed with a sloping inner wall 36 which is connected by a horizontal flange 38 to a vertical outer wall 40. The other sidewall 18 is a mirror image of sidewall 16 with spaced apart inner and outer walls 42 and 44 connected by a flange 46. Flanges 34, 38 and 46 are preferably coplaner.

The bottom 20 of the basin comprises a flat major panel 48 which slopes rearwardly from the front wall 12 and a flat minor panel 50 extends between the rear edge of the major panel and the rear wall 14. The minor panel 50 is horizontally oriented and includes a centrally positioned drain opening 52. A rigid drain tube fitting 54 extends downwardly from the opening 52 and is coupled with a flexible hosing 56 which may be connected at the other with a suitable drainage pipe such as a kitchen sink drain pipe.

A support flange 58 extends outwardly from the bottom edge of the sidewall 16 and extends along the length of the sidewall. A support flange 60 likewise extends outwardly from and along sidewall 18. Flanges 58 and 60 are preferably integrally formed with the sidewalls. Various suitable materials such thermoformed plastic materials may be used in the construction of the basin 10.

Turning more specifically to FIG. 2, an automatic dishwashing machine of conventional construction is represented somewhat schematically by the numeral 62. Dishwashing machine 62 comprises an outer support frame 64 which houses a pump 66 connected to a spray bar 68. Adjustable support legs 70 are coupled with the support frame 64 and are positioned beneath the dishwashing machine 62 at each corner.

The basin 10 is installed prior to installation of the dishwashing machine by first drilling a hole into the flooring at the location of the drain tube fitting 54. The basin 10 is then secured to the floor by adhesive or other suitable means and the flexible hosing 56 connected to the fitting 54 and a suitable drain pipe. It is to be understood that the fitting 54 need not extend into the flooring as other suitable methods for removing liquid from the basin may be used.

After installation of the basin 10, the dishwashing machine 62 may be easily installed by simply sliding the support legs 70 along the flanges 58 and 60 which extend outwardly along the sidewalls 16 and 18 of the basin. The sidewalls are spaced so that the flanges accommodate the dishwashing machine support legs 70 to provide a smooth surface along which the support legs 70 may be easily maneuvered during installation and removal of the machine. The cutout portion 22 of front wall 12 is necessary to provide clearance to accommodate passage of the dishwashing machine pump 66 or other components which typically extend beneath the machine.

The sidewall outer walls 40 and 44 also facilitate installation and removal of the dishwashing machine 62 by providing a guide surface for engaging the machine legs 70. As the machine support legs 70 move along the flanges 58 and 60, they are guided by the sidewall outer walls to maintain the machine in proper alignment. Otherwise, the machine could be easily misaligned, making installation and removal exceedingly difficult when there is only a slight gap between the machine and the cabinet trim.

When the basin 10 and dishwashing machine 62 are installed, any leakage from the machine drops into the basin where it is directed by the sloping construction of the inner walls and bottom major panel 48 to the drain opening 52. The leakage is then directed through hosing 56 to a suitable disposal area. It can thus be seen that the basin effectively prevents damage to the flooring and ceiling beneath the dishwashing machine should leakage occur.

Figure 4:
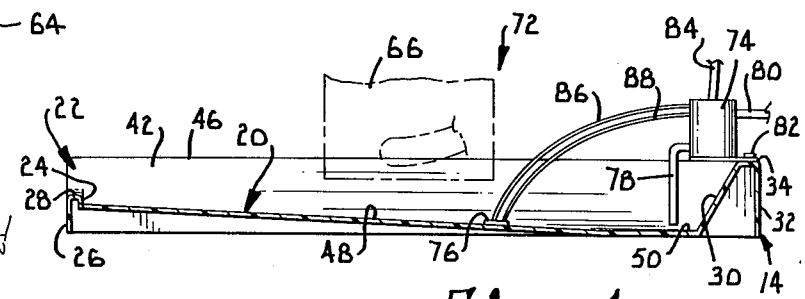
FIG. 4 is a fragmentary side sectional view similar to that of FIG. 3 but showing a modified embodiment of the invention.

Turning now to FIG. 4, a modified embodiment of a basin is represented broadly by the numeral 72. Basin 72 is identical in most respects to basin 10 previously described and like reference numerals have been used to identify like parts of the basins. Basin 72 differs from that previously described in that a pump 74 and moisture sensor 76 are utilized in place of a drain opening.

Pump 74 includes an inlet tube 78 which extends into the interior of the basin and an outlet tube 80 which is coupled with a drain pipe or other suitable disposal device. Pump 74 is attached to the rear wall 14 by a bolt 82 and is coupled by conductor 84 to a suitable source of electrical power. The pump may also be mounted at other suitable locations using other mounting techniques.

Moisture sensor 76 is positioned on the basin bottom 20 and is coupled with pump 74 by conductors 86 and 88. Sensor 76 may comprise various well known types of devices for provided a signal upon detection of moisture.

In use, the moisture sensor 76, upon detection of leakage entering the basin 72 from the dishwashing machine, sends a signal to the pump 74. Upon receipt of the signal, the pump cycles on for a predetermined period of time to remove the leakage from the basin. To prevent excessive cycling of the pump, the sensor is preferably positioned on the bottom major panel 48 so that leakage is allowed to accumulate to the desired level in the basin prior to activation of the pump. If desired, the sensor may also be connected to an audible or visual alarm to alert the homeowner to the presence of leakage so that repairs to the dishwashing machine may be effected. The basin thus provides an effective mechanism for collecting and removing leakage from the dishwashing machine to prevent damage to the flooring and ceiling beneath the machine.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A device for collecting leakage from a dishwashing machine including a single structure, said structure comprising:

sidewalls cooperating with front and rear walls and a bottom surface to form a collection basin with a hollow interior and an open top, said front wall being fixed and extending a distance intermediate the height of said sidewalls forming a cutout portion necessary to provide a clearance to accommodate passage of the diswashing machine pump means or other components which typically extend beneath the dishwashing machine, said bottom surface being inclined downwardly toward said rear wall;

means associated with said inclined bottom surface for effectively removing the leakage collecting in said basin; and said sidewalls having outer flange surfaces extending therefrom for providing a guide surface for guiding support legs of the dishwashing machine, said support legs movable along said flange surfaces and guided by the sidewall outer wall surfaces to maintain the dishwashing machine in proper alignment while making installation and removal exceedingly easy when there is only a slight gap between the dishwashing machine and wall structure means.

2. The invention of claim 1, wherein said means for removing the leakage comprises a drain opening positioned in said bottom.

3. The invention of claim 2, wherein said means for removing the leakage further comprises hosing coupled with said opening to route the leakage to a remote location.

4. The invention of claim 1, wherein said means for removing the leakage comprises a pump having an inlet tube positioned within said basin.

5. The invention of claim 4, including a moisture sensor positioned within the basin and coupled with the pump to activate the pump upon detection of said leakage.

* * * * *